United States Patent [19]

Saitoh

[11] 4,114,310

[45] Sep. 19, 1978

[54] SELF-POWERED TOY ANIMAL WITH OPENABLE AND CLOSABLE EYES

[76] Inventor: Shigeru Saitoh, No. 6-4, 2-chome, Kuramae, Taito-ku, Tokyo, Japan

[21] Appl. No.: 715,323

[22] Filed: Aug. 18, 1976

Related U.S. Application Data

[63] Continuation-in-part of Ser. No. 706,525, Jul. 19, 1976, Pat. No. 4,068,401.

[51] Int. Cl.[2] ..... A63H 11/00

[52] U.S. Cl. ..... 46/104; 46/141

[58] Field of Search ..... 46/92, 104, 141, 166

[56] References Cited

U.S. PATENT DOCUMENTS

| | | | |
|---|---|---|---|
| 1,223,372 | 4/1917 | Di Zerega | 46/104 |
| 2,389,833 | 11/1945 | Woditsch | 46/104 |
| 2,803,921 | 4/1957 | Garcia-Galiano | 46/141 UX |
| 3,120,079 | 2/1964 | Glass et al. | 46/166 |

*Primary Examiner*—Russell R. Kinsey
*Assistant Examiner*—Robert F. Cutting
*Attorney, Agent, or Firm*—Michael J. Striker

[57] ABSTRACT

A self-powered toy animal comprises a relatively small toy animal and a relatively large toy animal having an openable mouth. Drive means is provided inside one of the animals connected to a line having its other end connected to the other animal and passing through the mouth of the large animal. In addition, the large animal has a pair of eyes provided with lids which automatically close when the mouth opens. This large animal, which may be constituted as a fish or the like, will therefore appear to pursue and then eat the small animal as it pulls the small animal into its openable mouth, simultaneously closing its eyes as the small animal passes through the mouth into the interior of the large animal.

7 Claims, 5 Drawing Figures

SELF-POWERED TOY ANIMAL WITH OPENABLE AND CLOSABLE EYES

CROSS-REFERENCE TO RELATED APPLICATION

This application is a continuation-in-part of my copending patent application Ser. No. 706,525 filed July 19, 1976, now U.S. Pat. No. 4,068,401, the entire disclosure of which is herewith incorporated by reference.

BACKGROUND OF THE INVENTION

The present invention relates to a self-powered toy animal. More particularly this invention concerns a toy animal of the wind-up type.

Toys are known which resemble animals and are capable of displacing themselves along the land or in water. Such a toy frequently is very limited in its function, so that its appeal for a child is similarly limited. Thus after a very short time a child is bored with his or her toy and abandons it.

In my above-cited copending patent application I describe a toy comprising a relatively small toy animal and a relatively large toy animal connected via a line to the small animal and provided in its interior with a reel drivable for reeling in the small animal. The large animal has an openable mouth through which the line extends so that as it reels in the smaller animal it appears to eat this animal.

As further described in my earlier application both of the toy animals are made to float and the smaller animal is formed as a fish. The larger animal may be another fish, a hippopotamus, a duck or a similar fish-eating animal. This larger animal has a body part and a face part hinged on the body part and defining therewith the openable mouth.

In the toy according to my earlier application the drive means is a spring windup mechanism carrying the reel to which the one end of the line is attached. This line may be a flexible string, chain, or other flexible relatively inextensible element. In order to simplify functioning of the device the spring windup mechanism is wound up simply by opening the mouth of the large animal and pulling the small animal out of the interior of the large animal. This causes the line to unwind from the reel and thereby winds up the larger animal so that when the smaller animal is released the windup mechanism will automatically reel it in. Means is provided as described in my earlier application for displacing the larger animal through the water or on the land. This means is connected to the drive means so that as the smaller animal is being pulled in the larger animal follows along behind it, appearing to pursue, catch, and eat the smaller animal. Such displacement means may be a paddle formed as a tailfin of a fish constituting the larger animal, paddles carried on feet of a hippopotamus constituting the large animal, or paddles constituting the feet of a duck that is the larger animal.

As further described in my earlier application the paddles of the displacement means are displacable through substantially 90 degrees between a position extending parallel to the normal direction of travel of the animal and backwardly therein in a position extending transverse to this direction. Thus as the element carrying the paddle moves forward the paddle swings into a position parallel to the direction of travel so that it does not tend to pull the large animal backwardly, but when moved in the opposite direction the paddle straightens out and gives the large animal a forward impetus.

The toy according to my earlier invention has a long-lasting appeal for a youngster, as it does more than simply paddle along the water. Furthermore, such a toy can be produced at relatively low cost and will have a long service life.

SUMMARY OF THE INVENTION

It is an object of the present invention to improve on the above-described toy.

Another object is the provision of an improved toy.

These objects are attained according to the present invention in an arrangement essentially as described above, but wherein the large animal is provided with a plurality of ground-engaging idler wheels permitting it to roll along the ground. The small animal is provided with ground-engaging drive wheels which are in turn connected to the drive means which is mounted inside the small animal. Thus, this drive means inside the smaller leading animal serves to displace the animals along the ground as the small animal is pulled into the large animal. Thus an extremely lifelike effect is achieved with the small animal appearing to try to get away from the large animal which slowly catches up to it and eats it, stopping moving as soon as it has consumed the small animal.

According to a further feature of this invention the large animal is provided with at least one eye having a lid displaceable between an open and a closed position. Means in the large animal is connected between the face part for the eyelid for displacing this lid into the closed position during passage of the small animal through the mouth into the interior of the large animal. Thus as the large animal opens its mouth and apparently consumes the small animal it closes its eye or eyes in a lifelike and amusing manner.

According to further features of this invention the large animal has a pair of such eyes carried on the face part and each having a respective pivotal lid. An actuating member is connected to these lids engageable with the body part only when the mouth is closed to hold the lids in the open position. Thus when the mouth is closed the eyes are open and when the mouth opens the eyes are closed. This actuating member is a pin connected to the lids and extending through a hole in the face part toward the body part.

In accordance with this invention both of these animals may be constituted as fish. The large animal may be a fish of the goby type having protruding eyes, and the small animal may be a relatively small fish of the type typically eaten by the goby. It is also possible to form the large animal as any other animal which might eat a small animal as a fish or insect. Thus the large animal could be a duck or hippopotamus, and the small animal could be a fish or insect. It is also within the scope of this invention to make both of the animals floatable and provide one or the other of them with drive means for displacing them through the water as described in my above-cited copending patent application.

In accordance with yet another feature of this invention the drive means includes a spring windup mechanism having a windup spring with one end fixed in the respective animal and another end secured to the reel. A governor is provided for preventing the reel from rotating too fast so that the smaller animal will be pulled into the larger animal with a uniform speed. Such an arrangement is extremely simple and allows the spring mechanism to be wound up simply by pulling the small animal out of the large animal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

SPECIFIC DESCRIPTION OF PREFERRED EMBODIMENTS

Figure 1:
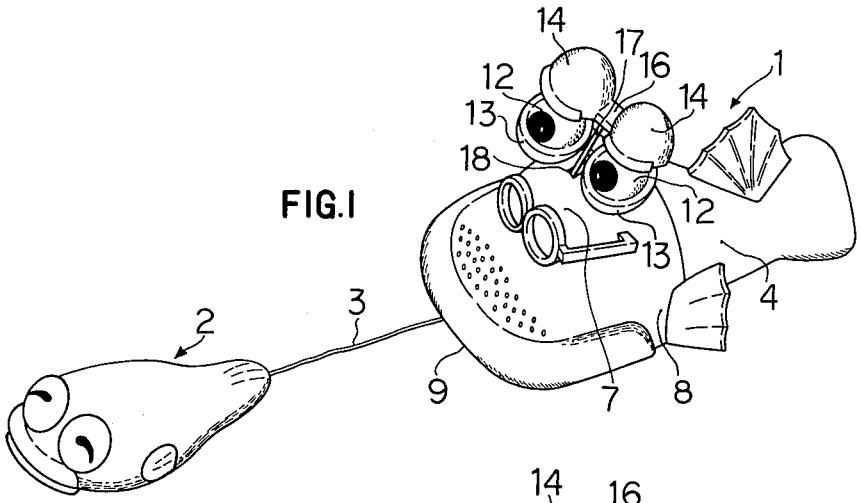
FIG. 1 is a perspective view of the arrangement according to this invention.
Figure 2:
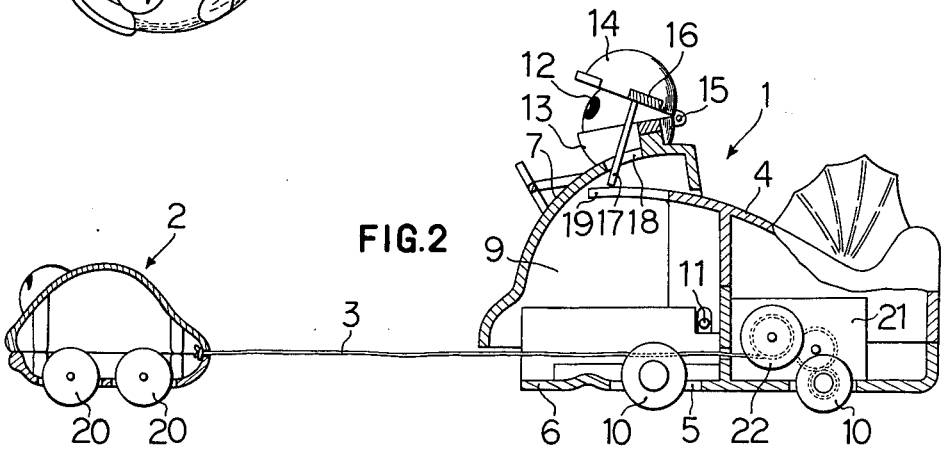
FIG. 2 is a vertical section through the toy in accordance with the present invention.

As shown in FIGS. 1 and 2, the toy according to this invention comprises a relatively large fish 1 of the goby type and a relatively small fish 2 resembling a minnow. A line 3 interconnects these fish 1 and 2.

The large fish 1 has a body 4 comprising a wheel base 5 and lower jaw 6. A face part 7 forms an upper jaw 8 that is pivoted at pins 11 on the body 4 and forms a mouth 9 with the lower jaw 6. In addition wheels 10 adapted to engage the ground are provided on the body part 4. Similar wheels 20 are provided on the prey fish 2.

In addition there is provided on the face part 7 a pair of forward-looking eyes 12 fixed in lower lids 13 and each having an upper lid 14 pivoted on the respective lower lid 14 at 15 and connected to the other upper lid 14 by means of a linking bar 16. An abutment pin 17 extends down from the linking bar 16 to a hole 18 in the face part 7 and engages a forwardly directed tongue portion 19 formed on the body part 4. When the face part 7 is in the closed position as indicated in FIG. 2, the pin 17 rests on the tongue 19 and holds the lids 14 in the illustrated open position.

In addition, the large animal 1 is provided internally with a windup mechanism 21 of the spring-type described in my above-cited copending patent application and having a reel 22 to which is connected one end of the line whose other end passes through the mouth 9 and is connected to the tail of the fish 2. This mechanism 21 is also connected to the rear drive wheels 10 in order that the mechanism 21 can displace the fish 1 along the ground.

Figure 3:
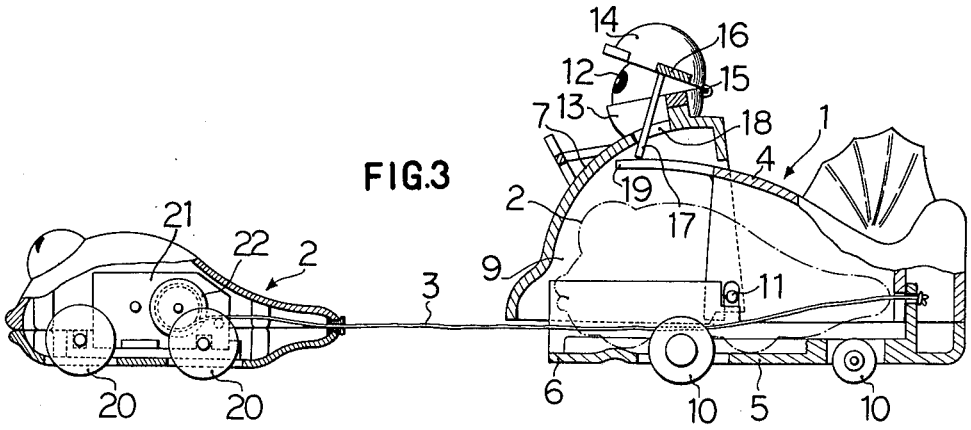
FIG. 3 is a section similar to FIG. 2 of another embodiment of the toy of this invention.
Figure 4:
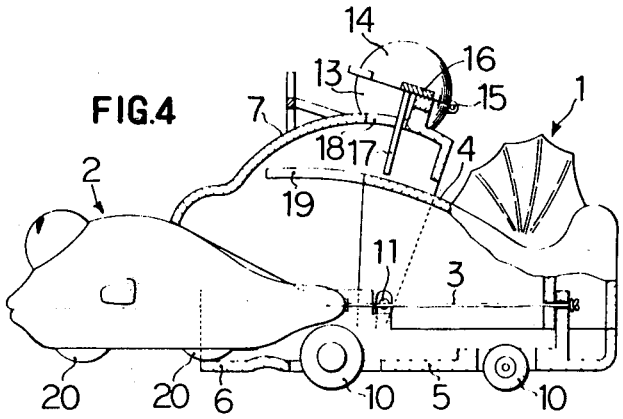
FIG. 4 is a section similar to FIG. 3 showing the operation of the toy of FIG. 3.
Figure 5:
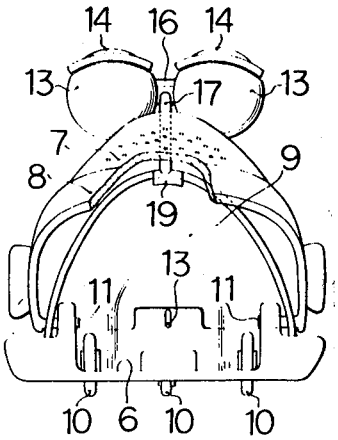
FIG. 5 is a front view, partly in section, of the toy as shown in FIG. 4.

FIGS. 3 – 5 show an arrangement wherein identical reference numerals are used for the same structure, but wherein the windup mechanism 21 is provided in the smaller fish 2 at the opposite end of the line 3 and is connected to the wheels 20 thereof. In this case the wheels 10 of the fish 1 are the idler type and the hollow interior is somewhat larger so as to accommodate the somewhat larger prey fish 2.

With both such arrangements the small animal 2 can fit inside the large animal 1. When the two are pulled apart so as to stretch the line 3 straightly between them the spring mechanism 21 is wound up. Thereafter, if the two are released the larger fish 1 will move toward the smaller fish 2 and pull it via the line 3 into its mouth 9. As this happens the face part 9 will pivot up on the pins 11, causing as shown in FIG. 4 the pin 17 to move out of contact with the pin 19. This action allows the upper lids 14 to close down onto the lower lids 13 and, therefore close the eyes. Thus the large fish 1 appears to close its eyes as it opens its mouth to swallow the small fish 2.

In the arrangement of FIGS. 1 and 2 the large fish will move forwardly toward the small fish 2 and may even pull this small fish 2 backwardly toward itself as it moves forward to eat it.

In the arrangement of FIGS. 3 – 5, however, the small fish 2 will appear to try to run away from the large fish 1, as it has the drive mechanism 2. Thus the small fish 2 will pull along the large fish 1, but as it winds up the line 3 the large fish 1 will come closer and closer to it, eventually opening its mouth and closing its eyes to pull the small fish 2 into its hollow interior. With this arrangement as soon as the small fish 2 is inside the large fish 1, this large fish 1 will come to rest, again with its eyes open.

It will be understood that each of the elements described above, or two or more together, may also find a useful application in other types of structure differing from the types described above.

While the invention has been illustrated and described as embodied in toy, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A toy comprising a relatively large toy animal having a hollow body part, a face part movable on said body part and defining therewith a mouth movable between open and shut positions, and at least one eye having a lid displaceable between an open position exposing said eye and a closed position covering said eye; a relatively small toy animal fittable into the interior of said body part; a tether passing through said mouth and having one end attached to one of said animals and an opposite end, drive means in the other of said animals attached to said opposite end for winding up said tether and thereby pulling said small animal into said large animal through said mouth and including a displacement element for travel of said other animal, during winding up of said tether, whereby said large animal appears to pursue and catch said small animal as said tether is wound up; and means in said large animal connected to said lid and operative for displacing said lid into said closed position in response to movement of said mouth to said open position thereof.

2. The toy defined in claim 1, wherein said large animal is provided with ground-engaging wheels and said drive means is provided in said large animal and is connected to said wheels for rotating the same and thereby displacing said large animal along the ground as said small animal is pulled in.

3. The toy defined in claim 1, wherein said small animal is provided with ground-engaging wheels and said drive means is provided in said small animal and is connected to said wheels for rotating the same and displacing said large and small animals along the ground as said small animal is pulled in.

4. The toy defined in claim 1 wherein said large animal has a pair of such eyes carried on said face part and each having a respective pivotal lid, said means connected between said lids and said mouth including an actuating member connected to said lids and engageable with said body part only when said mouth is closed to hold said lids in said open position, whereby said abutment member moves out of contact with said body part on passage of said small animal through said mouth so that said lids move into said closed position.

5. The toy defined in claim 4 wherein said abutment member is a pin connected to said lids and extending through said face part toward said body part, said face part having a portion engageable with said pin only when said mouth is closed.

6. The toy defined in claim 5 wherein said drive means is provided in said large animal.

7. The toy defined in claim 5 wherein said drive means is provided in said small animal.

* * * * *